US007228572B1

(12) United States Patent
Holden

(10) Patent No.: US 7,228,572 B1
(45) Date of Patent: Jun. 12, 2007

(54) DRAINED URINE RECEPTACLE

(76) Inventor: Desmond Frederick Holden, P.O. Box 26, Site 15, RR9, LCD 8, Calgary, AB (CA) T2J 5G5

( * ) Notice: Subject to any disclaimer, the term of this patent is extended or adjusted under 35 U.S.C. 154(b) by 0 days.

(21) Appl. No.: 11/203,637

(22) Filed: Aug. 15, 2005

(51) Int. Cl.
*A47K 11/00* (2006.01)

(52) U.S. Cl. ..... 4/144.1; 4/144.3; 4/310

(58) Field of Classification Search ..... 4/144.1, 4/307, 144.3, 301, 310
See application file for complete search history.

(56) References Cited

U.S. PATENT DOCUMENTS 3,703,731 A * 11/1972 Leiser ..... 4/144.3
3,726,521 A * 4/1973 Sidlauskas ..... 472/33
3,913,518 A * 10/1975 Kaplan ..... 40/612
4,982,455 A * 1/1991 Carter ..... 4/307
5,134,728 A * 8/1992 Sturm ..... 4/307
5,390,374 A * 2/1995 Hubrig et al. ..... 4/301
5,655,230 A * 8/1997 Corbin ..... 4/301

FOREIGN PATENT DOCUMENTS

JP 02115427 A * 4/1990 ..... 4/301
JP 06117010 A * 4/1994 ..... 4/301

* cited by examiner

*Primary Examiner*—Khoa D. Huynh
(74) *Attorney, Agent, or Firm*—G F. Gallinger

(57) ABSTRACT

A drained urinal comprises: an inverted truncated cone; a pivot arm connected beneath the truncated cone, having a hollow interior to drain urine therethrough; and, a base having a top portion adapted to receive and secure a bottom portion of the pivot arm, said base including a hinge to allow the pivot arm to bend down from an upright storage position to an oblique in-use position, and having a flat side portion adapted for attachment to a carrying surface. Most preferably the pivot arm has an adjustable length and the truncated cone has a top peripheral rim contoured to fit closely against a groin of a woman's body. The hinge comprises an upright flexible hose surrounded by a large cylindrical spring having a lower end portion secured in the base to thereby bias the pivot arm to the upright storage position.

12 Claims, 1 Drawing Sheet

DRAINED URINE RECEPTACLE

FIELD OF THE INVENTION

This invention relates to drained and supported urine receptacles. More particularly this invention relates to self supporting urine receptacles whose position may be adjusted for use.

BACKGROUND OF THE INVENTION

Urine receptacles offer a convenience of use which toilets do not. While mothers mostly would prefer their sons to sit on the toilet to urinate, rather than to stand, the boys much prefer to stand, and aim. Because young boys are relatively close to the toilet bowl, when they initially aim correctly, which is frequently not the case, there is minimal splatter. With men, who are much elevated above the toilet bowl, splatter of urine outside of the toilet bowl is much prevalent. The problem of properly directing urine flow from a greater distance away from the urine bowl is more challenging for men. Before cleaning public urinals all attest to this problem.

A self supporting urinal which has an adjustable position, a position which can readily adjusted, would mostly eliminate problems of misdirection and splatter. Another concern in home bathrooms today is space. What is needed is a urinal which would occupy minimal space. When the urinal is not being used it should be as unobtrusive as possible. The requirement of occupying minimal space is generally a trade off with convenience. The less something has to be put away, generally the more it is in the way while not in use. What is needed is a urinal which requires minimal adjustment so that it is generally in the right place, and a urinal which mostly puts itself away so that it is unobtrusive when not in use. The urinal should be able to be used by both men and women, and finally, the urinal should minimize water consumption.

OBJECTS OF THE INVENTION

It is an object of this invention to disclose an unobtrusive urinal. A urinal which occupies minimal space. The disclosed urinal occupies so little space that it could be stored between studs in a wall. It could be exposed by opening a door flush mounted on the face of the wall. It is an object of this invention to disclose a urinal which largely puts itself away while not in use. The disclosed urinal is biased to a storage position. The receptacle therein conveniently pivots from the storage position to an in use position when grasped. It is yet a further object of this invention to disclose a urinal which can accommodate either a man or a woman. It is yet a further object of this invention to disclose a urinal which can accommodate either an adult or a child. It is a final object of this invention to disclose a urinal which minimizes water consumption. The disclosed urinal requires no more than one cup of water to complete a flush.

One aspect of this invention provides for a drained urinal comprising: an inverted truncated cone; a pivot arm connected beneath the truncated cone, having a hollow interior to drain urine therethrough; and, a base having a top portion adapted to receive and secure a bottom portion of the pivot arm, said base including a hinge means to allow the pivot arm to bend down from an upright storage position to an oblique in-use position, and having a flat side portion adapted for attachment to a carrying surface.

In a preferred aspect of the urinal the pivot arm has an adjustable length and the truncated cone has a top peripheral rim contoured to fit closely against a groin of a woman's body.

In the most preferred embodiment of the invention the hinge means in the base comprises an upright flexible hose surrounded by a large cylindrical spring having a lower end portion secured in the base and an upper portion extending upwardly well beyond a top portion of the flexible hose which is banded over and around the pivot arm, said large spring thereby biasing the pivot arm to the upright storage position.

Various other objects, advantages and features of this invention will become apparent to those skilled in the art from the following description in conjunction with the accompanying drawings.

FIGURES OF THE INVENTION

Figure 1:
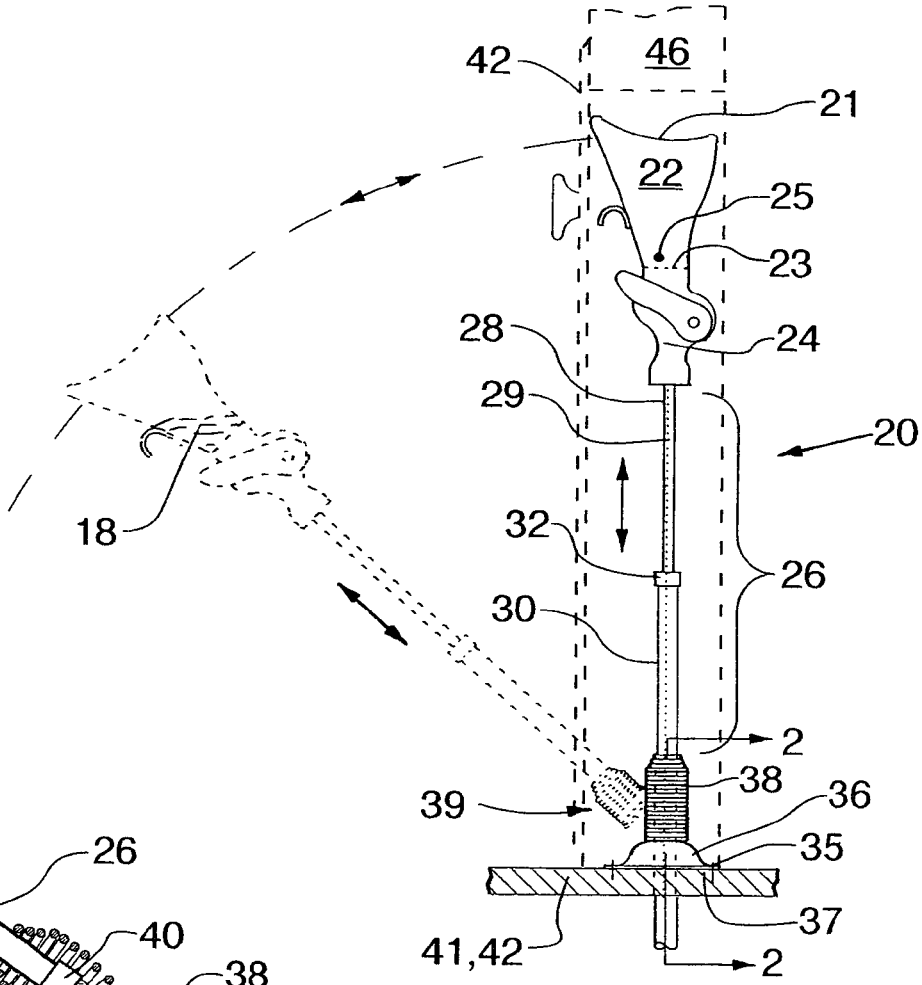
FIG. 1 is an elevational view of a drained urine receptacle.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have an elevational view of a drained urine receptacle 20. Most broadly, the drained urinal comprises: an inverted truncated cone 22; a pivot arm 26 connected beneath the truncated cone 22, having a hollow interior 29 to drain urine 18 therethrough; and, a base 36 having a top portion adapted to receive and secure a bottom portion of the pivot arm 26, said base 36 including a hinge means 39 to allow the pivot arm 26 to bend down from an upright storage position to an oblique in-use position, and having a flat side portion 37 adapted for attachment to a carrying surface 41. In the most preferred embodiment of this invention, in order to avoid the use of a trap (not shown) the urine receptacle further comprises a valve 24 connected to and beneath the cone 22, said valve 24 carried by a top portion of the pivot arm 26. Most preferably, the valve 24 is biased to a normally closed position to prevent back flow of noxious vapors.

In the most preferred embodiment of the invention the pivot arm 26 has an adjustable length and comprises a lower portion 30, which slidably receives an upper portion 28, and a lock ring 32 which when tightened adjustably seals the upper portion 28 and lower portion 30 together at a selected height. In use the lock ring 32 should only be tightened sufficiently to make a seal so that the length can be subsequently adjusted. The cone 22 will then be held at the correct height and position by the hand holding the valve open. A debris screen 23 positioned across a bottom portion of the truncated cone 22 prevents debris 25 from entering the valve 24 or plugging the hollow interior 29 of the pivot arm 26.

The most preferred embodiment also includes a truncated cone 22 having a top peripheral rim 21 contoured to fit closely against a groin of a woman's body. The flat side portion 37 of the base 36 is adapted for seating on, and attachment, through peripheral holes 35 therearound, to a generally horizontal surface 41.

Figure 2:
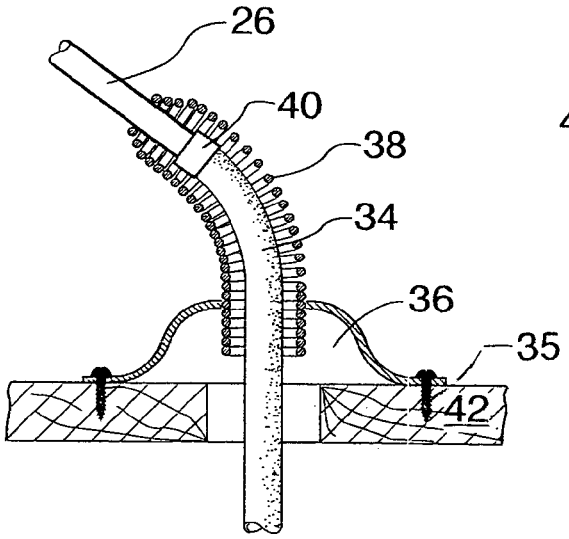
FIG. 2 is an enlarged partial cross sectional view of the base portion of the urinal taken along line 2-2 in FIG. 1.

FIG. 2 is an enlarged partial cross sectional view of the base 36 portion of the urinal 20 taken along line 2-2 in FIG. 1. In the most preferred embodiment of the invention the hinge means 39 in the base 36 comprises an upright flexible hose 34 surrounded by a large cylindrical spring or means for biasing 38 having a lower end portion secured in the base 36 and an upper portion extending upwardly well beyond a top portion of the flexible hose 34 which is banded 40 over and around the pivot arm 26, said large spring 38 thereby biasing the pivot arm 26 to the upright storage position (as shown in FIG. 2).

Figure 3:
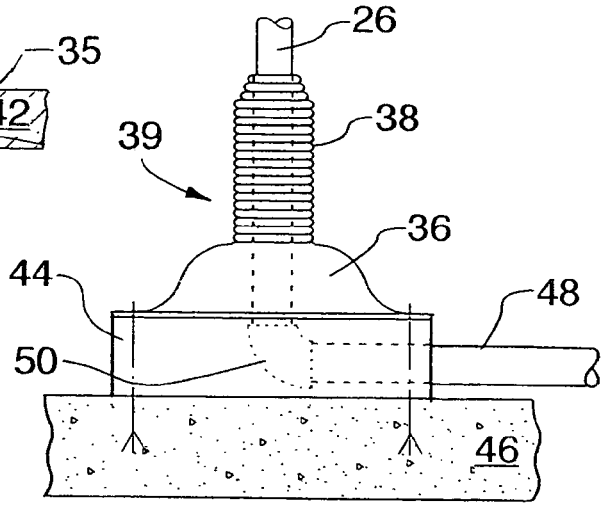
FIG. 3 is a partial cross sectional view of the base portion of the urinal further comprising a pedestal used when the base is mounted on a concrete slab.

FIG. 3 is a partial cross sectional view of the base 36 portion of the urinal 20 further comprising a pedestal 44 used when the base 36 is mounted on a concrete slab 46. When the base 36 is intended to be mounted on a concrete slab 46 and when the drain line 48 is intended to run above the concrete slab 46, the urinal 20 further comprises a pedestal 44 on which the base 36 is mounted so that an elbow 50 can be positioned between a bottom portion of the flexible hose 34 and the drain line 50 both above the concrete slab 46.

A method of urinating with the urinal 20 most broadly described above comprises the step of: moving the pivot arm 26 from an upright position; and then urinating within the inverted truncated cone 22. When the urinal 20 has a valve 24 which is biased to a normally closed position to prevent back flow of noxious vapors, and connected to and beneath the cone 22 and carried by a top portion of the pivot arm 26, said method further comprising the step of holding open the valve 24 after one begins urinating to allow urine to drain away. When the pivot arm 26 has an adjustable length and comprises a lower portion 30, which slidably receives an upper portion 28, and a lock ring 32 which when tightened locks the upper and lower portions 28,30 together at a selected height; said method further comprising the step of loosening the lock ring 32, adjusting the length of the pivot arm 26 to an optimal length to position the inclined truncated cone 22 at an optimal height, and thereafter tightening the lock ring 32. In use the lock ring 32 should only be tightened sufficiently to make a seal so that the length can be subsequently adjusted. The cone 22 will then be held at the correct height and position by the hand holding the valve open. And when the truncated cone 22 has a top peripheral rim 21 contoured to fit closely against a groin of a woman's body, said method further comprising the step of the women pressing her groin against the truncated cone prior to urination. And finally, when the urinal 20 is mounted within a wall 16, the method further comprises the steps of opening a flush mounted wall door 42; and finally after using and releasing the urinal 20, closing the door 42 to exclude the urinal 20 from view.

While the invention has been described with preferred specific embodiments thereof, it will be understood that this description is intended to illustrate and not to limit the scope of the invention, which is defined by the following claims.

I claim:

1. A drained urinal comprising:

an inverted truncated cone;

a pivot arm connected beneath the truncated cone, having a hollow interior to drain urine therethrough, wherein the pivot arm has an adjustable length and comprises a lower portion which slidably receives a upper portion in a telescopic relation in order to adjustably seal the upper and lower portions together at a selected height;

a valve, connected to and beneath the cone, and carried by a top portion of the pivot arm; said valve biased to a normally closed position to prevent back flow of noxious vapors and, a base having a top portion adapted to receive and secure a bottom portion of the pivot arm, said base including a hinge means to allow the pivot arm to bend down from an upright storage position to an oblique in-use position, and having a flat side portion adapted for attachment to a carrying surface, wherein the hinge means in the base comprises an upright flexible hose surrounded by means for biasing having a lower end portion secured in the base and an upper portion extending upwardly well beyond a top portion of the flexible hose which is banded over and around the pivot arm, said means for biasing thereby biasing the pivot arm to the upright storage position.

2. A drained urinal as in claim 1 wherein the pivot arm further comprises a lock ring.

3. A drained urinal as in claim 2 further comprising a debris screen positioned across a bottom portion of the truncated cone to prevent debris from entering the valve or plugging the hollow interior of the pivot arm.

4. A drained urinal as in claim 3 wherein the truncated cone has a top peripheral rim contoured to fit closely against a groin of a woman's body.

5. A drained urinal as in claim 1 wherein the carrying surface is generally horizontal and wherein the flat side portion of the base is adapted for seating on, and attachment, through peripheral holes therearound, to the generally horizontal surface.

6. A drained urinal as in 1 wherein the base is intended to be mounted on a concrete slab and wherein the drain line is intended to run above the concrete slab, further comprising a pedestal on which the base is mounted so that an elbow can be positioned between a bottom portion of the flexible hose and the drain line both above the concrete slab.

7. A method of urinating with a urinal comprising the steps of:

providing a drained urinal having an inverted truncated cone, a pivot arm connected beneath the truncated cone, said pivot arm having a hollow interior to drain urine therethrough wherein the pivot arm has an adjustable length and comprises a lower portion which slidably receives a upper portion in a telescopic relation in order to adjust the upper and lower portions together at a selected height, a valve, connected to and beneath the cone and carried by a top portion of the pivot arm, said valve biased to a normally closed position to prevent back flow of noxious vapors, and a base having a top portion adapted to receive and secure a bottom portion of the pivot arm, said base including a hinge means to allow the pivot arm to bend down from an upright storage position to an oblique in-use position, and having a flat side portion adapted for attachment to a carrying surface wherein the hinge means in the base comprises an upright flexible hose surrounded by means for biasing having a lower end portion secured in the base and an upper portion extending upwardly well beyond a top portion of the flexible hose which is banded over and around the pivot arm, said means for biasing thereby biasing the pivot arm to the upright storage position; and, moving the pivot arm from an upright position;

holding open the valve after one begins urinating to allow urine to drain away; and then, urinating within the inverted truncated cone.

8. The method as in claim 7 wherein the pivot arm further comprises a lock ring; said method further comprising the step of loosening the lock ring, adjusting the length of the pivot arm to an optimal length to position the inclined truncated cone at an optimal height, and thereafter tightening the lock ring.

9. The method as in claim 8 wherein the urinal has a debris screen positioned across a bottom portion of the truncated cone to prevent debris entering the valve or the hollow interior of the pivot arm.

10. The method as in claim 8 wherein the truncated cone has a top peripheral rim contoured to fit closely against a groin of a woman's body, said method further comprising the step of the women pressing her groin against the truncated cone prior to urination.

11. The method as in claim 10 wherein the wherein the flat side portion of the base is adapted for seating on, and attachment, through peripheral holes therearound, to a generally horizontal surface.

12. The method of urinating with a urinal mounted within a wall as described in claim 7 further comprises the following steps:

opening a flush mounted wall door; and finally after releasing the urinal, closing the door to exclude the urinal from view.

* * * * *